US008281533B2

(12) United States Patent
Jablonka

(10) Patent No.: US 8,281,533 B2
(45) Date of Patent: Oct. 9, 2012

(54) ATTACHMENT ELEMENT FOR STUDDED PLASTIC SHEETS

(75) Inventor: Marcus Jablonka, Vineland (CA)

(73) Assignee: Ewald Doerken AG, Herdecke (DE)

( * ) Notice: Subject to any disclaimer, the term of this patent is extended or adjusted under 35 U.S.C. 154(b) by 217 days.

(21) Appl. No.: 12/589,386

(22) Filed: Oct. 22, 2009

(65) Prior Publication Data

US 2010/0107540 A1 May 6, 2010

(30) Foreign Application Priority Data

Oct. 23, 2008 (DE) ..... 10 2008 052 891

(51) Int. Cl.
*E04B 5/00* (2006.01)

(52) U.S. Cl. ..... 52/409; 52/410; 52/506.05; 52/512

(58) Field of Classification Search ..... 52/293.3, 52/701, 712, 714, 411, 408, 409, 169.11, 52/169.5, 410, 506.05, 512; 248/200, 300, 248/27.1

See application file for complete search history.

(56) References Cited

U.S. PATENT DOCUMENTS 4,531,870 A * 7/1985 Moryl et al. ..... 411/108
4,977,721 A * 12/1990 Blosseville et al. ..... 52/410
5,144,727 A * 9/1992 Craft ..... 27/2
6,315,489 B1 * 11/2001 Watanabe ..... 403/381
6,523,309 B1 2/2003 Finlay et al.
6,830,405 B2 * 12/2004 Watanabe ..... 403/14
7,504,407 B2 3/2009 Castelhano et al.
7,598,252 B2 10/2009 Castelhano et al.
7,735,785 B2 * 6/2010 Wippler et al. ..... 248/27.1
2002/0139068 A1 * 10/2002 Janesky ..... 52/169.5

FOREIGN PATENT DOCUMENTS

WO WO 2004/106642 A1 1/2010

* cited by examiner

*Primary Examiner* — Mark Wendell

(74) *Attorney, Agent, or Firm* — Hudak, Shunk & Farine Co. LPA

(57) ABSTRACT

The invention relates to an attachment element for studded plastic sheets comprising a base body with at least one stud projecting from a front of the base body. To provide an attachment means that results both in a tear-resistant attachment of the studded plastic sheet to the building wall and in extensive surface contact at a top edge of the studded plastic sheet, it is provided that a head portion is arranged on the base body, which fully or at least partially projects from the front of the base body with a resiliently deformable area.

18 Claims, 4 Drawing Sheets

ATTACHMENT ELEMENT FOR STUDDED PLASTIC SHEETS

FIELD OF THE INVENTION

The invention relates to an attachment element for studded plastic sheets comprising a base body with at least one stud projecting from a front of the base body.

BACKGROUND OF THE INVENTION

Studded plastic sheets, which will be referred to as studded sheets in the following, are primarily used in the building industry for the protection of structural parts of buildings, such as foundation walls, in soil contact. In its installation position as a foundation protection, in which the studded sheet is arranged directly in front of a foundation wall or in front of a seal, an insulation or the like of the foundation wall, the studded sheet protects the foundation wall, or the building components arranged in front of it against the filling material, such as debris, sand, soil or the like. At the same time it fulfills a drainage function, by draining water penetrating between the building wall and the studded sheet or between the studded sheet and the filter.

To ensure a long-term functioning of the system structure of the foundation protection, it is necessary for the studded sheets, in their installation position, to be in extensive surface contact with the building body in its upper portion so that filling material, dirt or the like, does not get introduced during or after the building phase, which would adversely affect the function of the studded sheet as a protection or drainage layer and would lead to damage to the building.

To attach the studded sheet, which is usually configured without studs at its, in the installation position, top edge to ensure extensive surface contact, it is known to use attachment elements formed as washers or frusto-coni, which are inserted into a stud. Each washer or frusto-cone has an opening through which the actual attachment means, such as a nail, a screw, a rivet or a dowel, is passed to attach the studded sheet on the building body in the area of the receiving stud. While these attachment elements already prevent the studded sheet from getting torn or torn away from the substructure, it must be noted that the risk of the studded sheet getting torn down has not been satisfactorily excluded, particularly if longer/wider plastic sheets are to be attached. Moreover, a great number of attachment points are necessary, which leads to the installation being very cumbersome (involving a lot of work). Over and above that, the attachment elements do not fulfill any attachment function (pressing function) with respect to the top end region of the studded sheet, thus necessitating further measures.

To improve the attachment of the studded sheet it is known to use an attachment element having a plurality of studs, wherein the studs are arranged and formed on the attachment element in a manner corresponding to the studs on the studded sheet to be attached. While such an attachment element may improve the tear resistance and reduce installation work, the use of such attachment elements still requires later attachment of the top edge of the studded sheet to the building wall. The previously described attachment elements cannot be used for this purpose since the studded plastic sheets are formed without studs in the area of their top edges to ensure extensive surface contact. Such surface contact is achieved only to a very insufficient extent, or only with a considerable amount of additional work. Currently, separate attachment elements, such as bars, sections, rods or the like, are used to press the top edge against the building wall.

SUMMARY OF THE INVENTION

It is therefore the object of the invention to provide an attachment element that facilitates both tear-free attachment of the studded plastic sheet to the building wall and extensive surface contact of a smooth top edge of the plastic sheet.

The invention achieves the object by an attachment element having the features of claim 1. Advantageous embodiments of the invention are defined in the dependent claims.

The attachment element according to the present invention, which will be described in the following with reference to its use for the attachment of a studded sheet on a building wall for better illustration, but without limitation, is characterized by a head portion arranged on the base body, which projects completely or at least partially from the front of the base body with a resiliently deformable portion, wherein the front is formed by that surface of the base body which, in the installation position, is in contact with the studded sheet to be attached. The base body, with its at least one stud projecting from the front, enables the reliable and tear-resistant attachment of the studded plastic sheet to the building wall. Herein, the size and shape of the stud is advantageously adapted to the studs of the studded sheet to be attached to achieve a good interlocking connection with the studded sheet. In addition to the at least partially resilient configuration of the head portion, the attachment element can also be formed in such a way overall that it exerts stress/pressure on the smooth top edge as it is attached to the wall.

The head portion forming an extension of the base body is configured in such a way that, in the installation position of the attachment element, it is in contact with the stud-free top edge of the studded sheet when the base body is arranged in a top-most stud row of the studded sheet, or in a row far at the top, with respect to the installation position.

The resiliently deformable area of the head portion projecting from the front of the base body, in the installation position of the attachment element, has the effect that the edge of the studded sheet is pressed into contact with the building wall as the area of the head portion in contact with the top edge is resiliently deformed in the installation position. The deformation of the resiliently deformable area or of the entire attachment element, if it is essentially entirely deformable, happens automatically during the application of the attachment element to the studded sheet, since the resiliently deformable area is already in contact with the top edge of the studded sheet due to its projecting configuration with respect to the base body, when the base body with its stud is not yet fully arranged in the associated stud of the studded sheet. The restorative force resulting from the resilient deformation exerts contact pressure on the top edge of the studded sheet. The important thing for the proper functioning of the attachment element according to the invention is that the head portion is resiliently deformed by the attachment of the attachment element to the studded sheet and thus the top edge of the studded sheet is pressed against the building wall, wherein the head portion can be at least partially arranged parallel to the top edge of the studded sheet.

The attachment element according to the present invention has the effect on the one hand that a particularly reliable and tear-resistant attachment of the studded sheet is ensured. On the other hand, continuous contact of the top edge of the studded sheet is achieved on the substructure, such as on the building wall. These two objects are achieved in one step, namely by arranging the attachment element. An additional step to exert extensive surface pressure on the top edge of the studded sheet on the building wall can be dispensed with if the attachment element of the present invention is used.

The configuration of the attachment element such that the head portion projects at least partially from the front of the base body with its resiliently deformable area, is basically freely selectable. A possibility is, for example, the use of separate deformation bodies or the arrangement of the base body at an angle to the head portion. It is also possible, as explained before, to configure the entire attachment element so that it is resiliently deformable in a cost-effective manner. Sufficient pressure is exerted, however, if the head portion is only partially resiliently configured. According to a particularly advantageous embodiment of the invention, the base body and/or the head portion is curved about at least one axis, preferably two axes, extending in a plane of the base body and/or the head portion.

According to this embodiment of the invention, the base body and/or the head portion has a curved or a dome-shaped configuration. The degree of curvature and the orientation of the curvature are basically freely selectable and can be achieved by a curvature about one axis, or even a curvature about a plurality, preferably two, axes, so that the base body, the head portion or the entire attachment element have a dish shape. The axes extend in a plane of the attachment element, wherein they are also subject to curvature if there is a curvature about more than one axis.

Curvature results in the head portion having an area protruding with respect to the front of the base body, which, in the installation position of the attachment element, in which the base body is arranged so that its stud is essentially completely received in the stud of the studded sheet, reliably presses the top edge of the studded plastic sheet against the building wall. The curved embodiment of the attachment element, or the base body or the head portion, ensures in a particularly advantageous fashion that the pressure exerted on the head portion is uniform and reliable over the entire width. Moreover, the curved embodiment of the attachment element can be manufactured in a particularly easy and cost-effective manner.

The embodiment of the attachment element according to the present invention alone results, as explained before, in a considerable reduction of the work needed to attach the studded sheet to the building wall, since later attachment of the top edge of the studded sheet can be dispensed with. A further reduction of the work to be expended can be achieved according to an advantageous embodiment by configuring the head portion in such a way that the latter has wings protruding from the outside in an area facing away from the base body. The area facing away from the base body is the area which is in contact with the top edge of the studded sheet in the installation position and which presses it against the building wall. The use of wings protruding to the outside enlarges in a complementary fashion the area used by the attachment element to contact the top edge of the studded sheet. The number of attachment elements needed overall to attach, or press, or urge, the studded sheet can thus be further reduced, which also results in a reduction of assembly work as well as in a reduction of material expenditure.

To ensure a particularly uniform exerted pressure, according to a further embodiment of the invention, the wings have a curvature adapted to the head portion, so that in the installation position of the attachment element, the top edge of the studded sheet is reliably fixed to the building wall over the entire length of the head portion. It is particularly advantageous that, in the installation position, the head portion is parallel and in contact with the top edge.

The configuration of the wings, in particular in the area of the front surface, which faces or is in contact with the studded sheet in the installation position, is basically freely selectable. They can, for example, have a flat configuration to achieve extensive surface contact in the installation state. According to a particularly advantageous embodiment of the invention, however, the wings have a boss projecting from the front surface as seen in cross-section, which particularly advantageously has a curved configuration. The use of such a boss ensures in a complementary manner that the front of the attachment element or the wings are in reliable contact with the studded sheet in the installation position of the attachment element. Moreover, the boss has the result of increasing the strength of the wings and thus of increasing the pressure exerted on the top edge of the studded sheet in the installation position.

According to a particularly advantageous embodiment of the invention, the cross-section of the boss varies in the longitudinal direction of the wings. By these means, an adaptation or configuration of the wings can be achieved, which has the effect that the boss, in the installation position, is in linear or extensive surface contact at the top edge of the studded sheet as a function of its cross-section, which achieves particularly reliable fixing of the studded sheet to the building wall. According to this embodiment of the invention, the cross-section of the wings can be enlarged, for example, toward their ends.

The configuration of the head portion with the wings to be advantageously provided is also basically freely selectable. According to a particularly advantageous embodiment of the invention, the outside of the head portion however has a curved configuration in the transition region to the wings. This embodiment of the invention ensures on the one hand a particularly high exerted pressure and, on the other hand, it prevents folding or tearing of the head portion as could be the case with outer surfaces arranged at an angle, for example at right angles to one another, and which would lead to a reduction of the pressure exerted.

To increase the strength or to increase the pressure exerted, it is provided according to an embodiment of the invention that reinforcing webs are arranged on the back of the head portion and/or the base body. These webs, which advantageously protrude from the back of the head portion or the base body, increase the bending stiffness and thus ensure the exertion of high pressure even with a small resilient deformation. Furthermore, if according to a further embodiment of the invention the webs extend from an area for accommodating an attachment means, with which the attachment element is fixed to the studded sheet, to the outsides, preferably toward an end face of the head portion facing away from the base body, it can be ensured in a particularly reliable manner that reliable pressure is exerted on the top edge of the studded sheet by the arrangement of the base body on the studded sheet. The reinforcement webs transfer in a particularly suitable manner the pressure of the base body generated by the attachment on the top area of the head portion.

To arrange the attachment element on the studded sheet it is provided according to a particularly advantageous embodiment of the invention that a stud of the base body is formed so that it receives the attachment means. By these means, an additional configuration of the attachment element to provide for its fixing on the studded sheet can be dispensed with. In a particularly advantageous manner, the at least one stud of the base body has an opening to receive the attachment means so that the attachment element need not be specially prepared for this purpose.

Preferably, the opening is arranged in a base of the stud. This embodiment ensures in a particularly advantageous manner that the attachment means presses the attachment element in the area of the attachment means against the studded sheet to be attached, or the building wall arranged behind it, in extensive surface contact. Cavities between the building wall, the studded sheet and/or the attachment element in the area of the attachment means, which could facilitate tearing and would also result in a reduction of the pressure exerted, are effectively avoided thereby.

Moreover, this is also achieved by an advantageously provided configuration of the stud that receives the attachment means essentially as a solid body, whereby the tear resistance is increased in a complementary manner and a particularly reliable arrangement of the attachment means and the attachment element is achieved on the studded sheet or the building wall. A puncturing or perforating effect is thus avoided.

For the attachment element according to the present invention to function it is basically sufficient if the base body has one stud to be joined with the studded sheet to be attached. According to a particularly advantageous embodiment of the invention, however, the base body has four or five studs, but it can also have an even greater number of studs. The latter are arranged on the base body according to the studs of the studded sheet to be attached so that a particularly advantageous interlocking connection can be established. In a particularly advantageous manner, four of the five studs are arranged in such a way that they form the corner points of a square, and the fifth stud forms the stud to receive the attachment means and is arranged at the center of the square.

The arrangement of the attachment element on the studded plastic sheet can be carried out in the simplest manner by the use of nails to be manually driven in. To simplify installation, however, the use of manual nailers is also known, which automatically shoot a nail with a predetermined force at the press of a button.

According to a particularly advantageous embodiment of the invention, a connector for such an apparatus for positioning the attachment means is arranged in the area for receiving the attachment means. The connector, which is particularly advantageously annular, in particular circular, and which is preferably arranged coaxial to the opening on the back of the base body, enables particularly disruption-free use of such apparatuses/tools and thus particularly rapid attachment of the studded sheet if they are specially configured for use with the above-mentioned apparatuses. At the same time, it is ensured in a particularly advantageous way that the attachment means is positioned in the place provided on the attachment element. It may thus be prevented in a particularly advantageous way that the attachment element is destroyed by an incorrectly positioned attachment means. The nailer can thus be reliably aligned by hand, and the free hand can be used to position the sheet.

The embodiment of the attachment element is basically freely selectable, as explained above. According to a particularly advantageous embodiment of the invention, the base body and the head portion are integrally configured, however, which enables particularly simple and cost-effective manufacture of the attachment element.

According to an embodiment of the invention, the attachment element is of a thermoplastic plastic material, in particular of impact-resistant copolymer having high bending strength and a high modulus of elasticity manufactured by injection molding. The use of a plastic material is characterized by high bending stiffness, wherein a high pressure is already exerted with small resilient deformation. At the same time, the plastic material has a long life and a high dimensional stability so that a reliable arrangement of the top edge of the studded sheet can be ensured on the building wall on a long-term basis.

BRIEF DESCRIPTION OF THE DRAWINGS

An exemplary embodiment of the invention will be explained in more detail in the following with reference to the accompanying drawings, wherein.

DETAILED DESCRIPTION OF THE INVENTION

Figure 1:
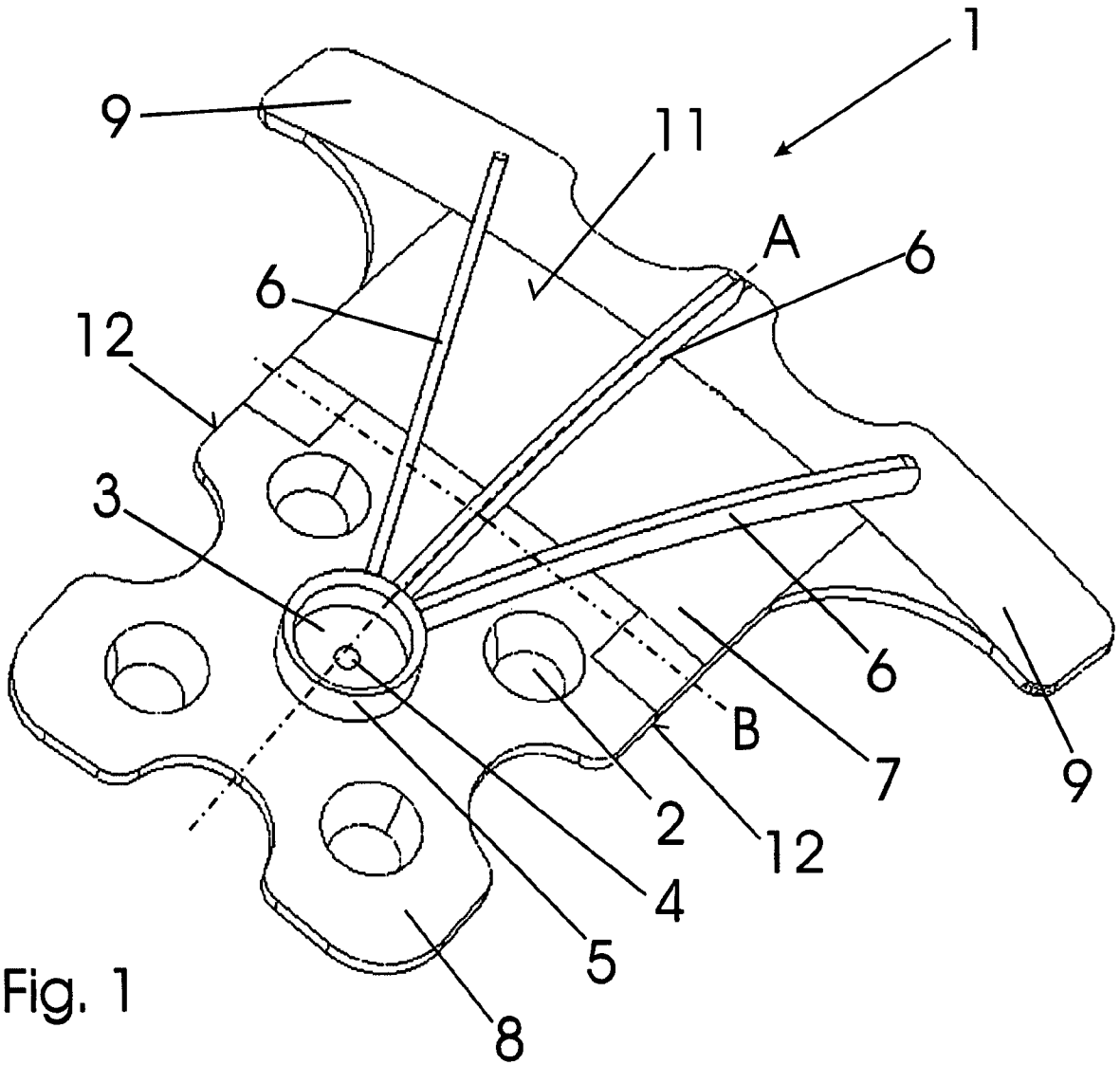
FIG. 1 is a perspective view of a back of an attachment element.
Figure 2:
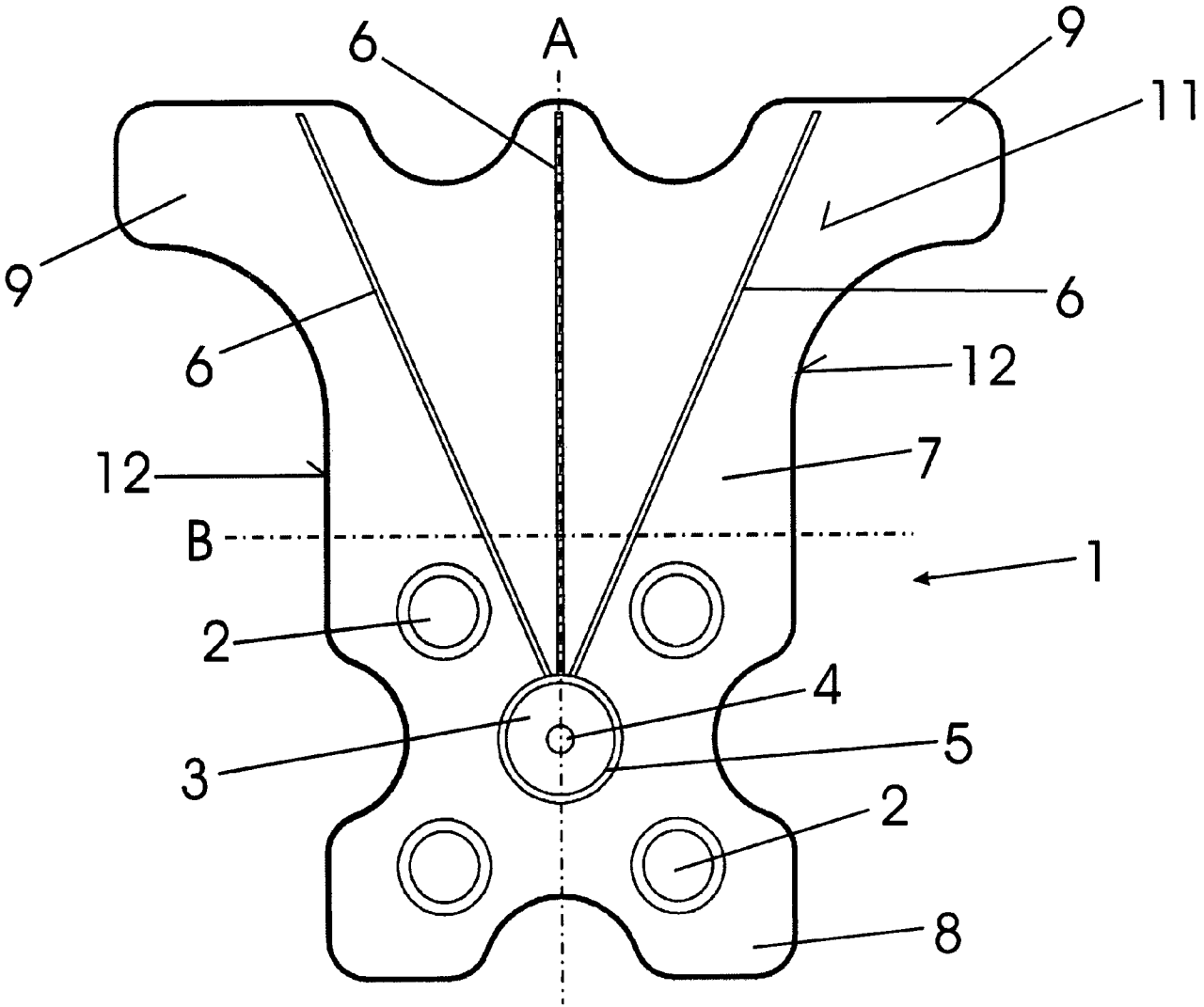
FIG. 2 is an elevational back view of the attachment element of FIG. 1.
Figure 3:
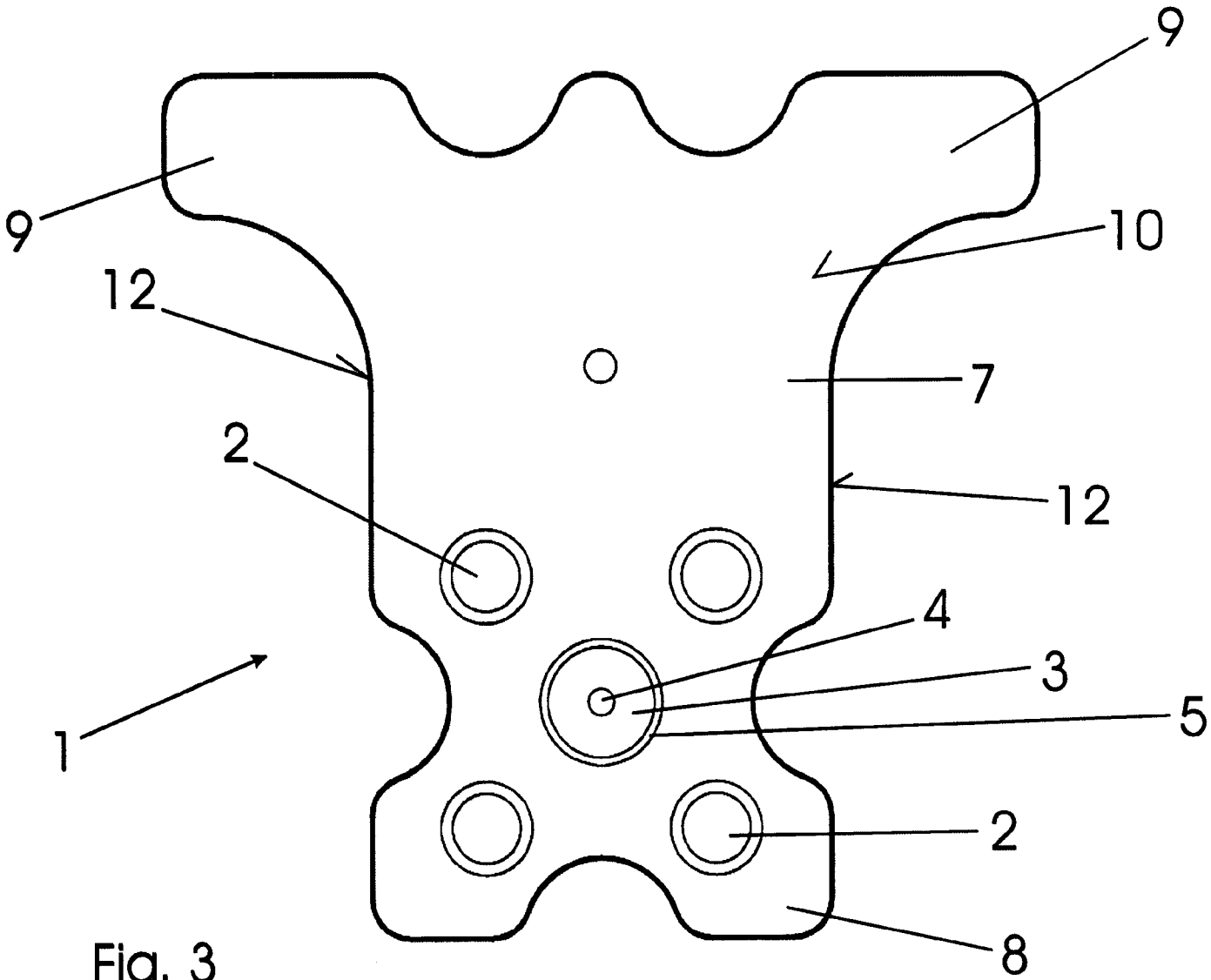
FIG. 3 is an elevational front view of the attachment element of FIG. 1.
Figure 4:
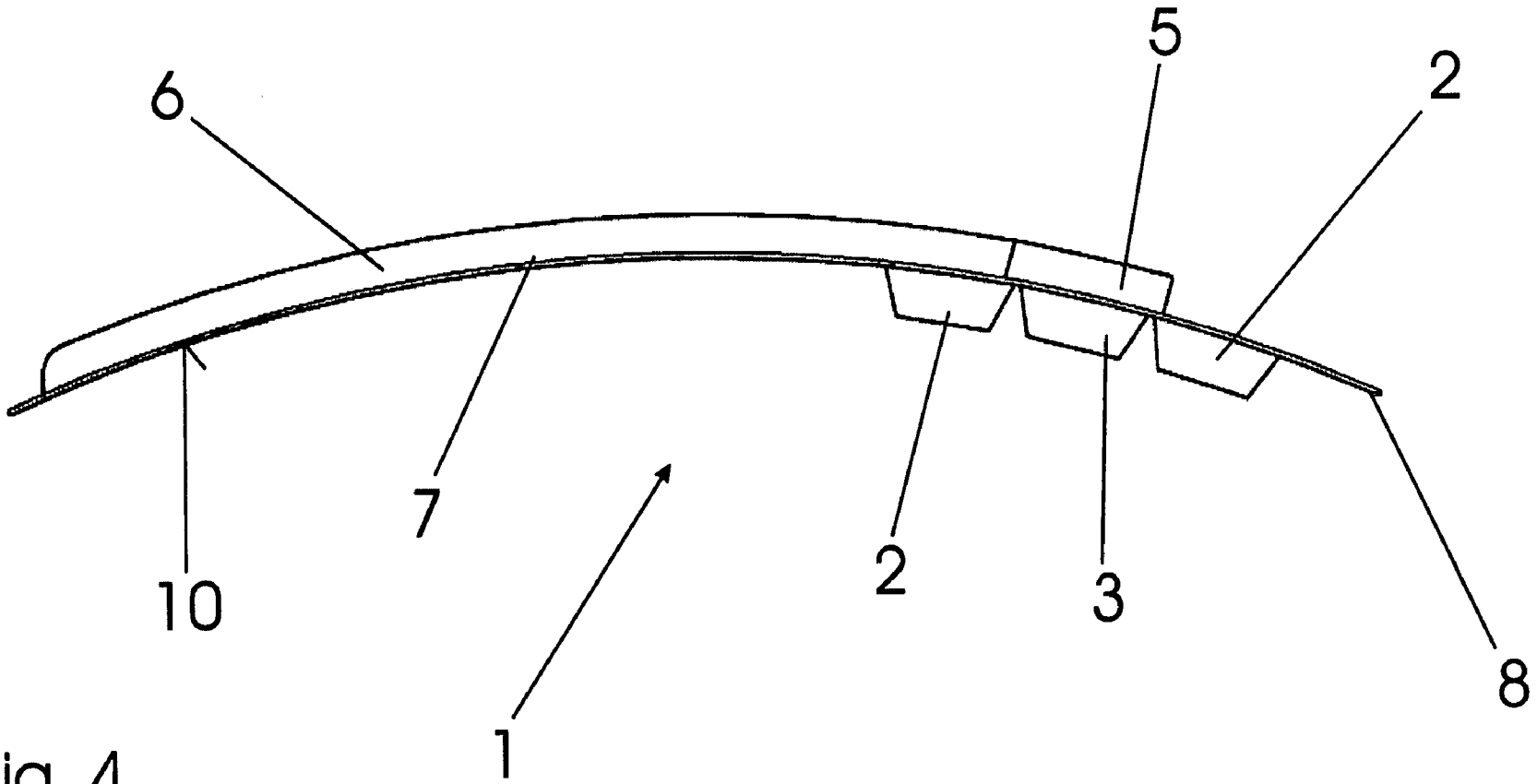
FIG. 4 is a side view of the attachment element of FIG. 1.

Integrally formed attachment element 1 shown in FIGS. 1-4 is of plastic material and has a base body 8 and a head portion 7 as an extension of base body 8.

Base body 8, with which attachment element 1 is attached on a studded plastic sheet (not shown) in interlocking and frictional engagement, has four hollow studs 2, arranged in the form of a square, formed so that they extend from a plane of the base body 8 and protrude from a front 10 of attachment element 1. Between studs 2, a solidly formed stud 3 is centrally arranged, which also protrudes from the front 10 of base body 8. The arrangement of studs 2, 3 is adapted to the arrangement of the studs on the studded sheet to be attached.

To attach a stud-free, i.e. planar, top edge of the studded sheet to a building wall, attachment element 1 is inserted with its studs 2, 3 in an associated top stud row of the studded sheet, and then attached to the building wall by means of an attachment means, such as a nail, which is passed through an opening 4 of stud 3, wherein studs 2, 3, in the installation position, are essentially fully arranged in the studs of the studded sheet.

In the installation position of attachment element 1, head portion 7 is pressed moreover with a biasing pressure against the top edge of the studded sheet. The biasing pressure results from a curvature of attachment element 1, wherein base body 8 and head portion 7 are curved about common axes A, B extending in a plane of attachment element 1, wherein head portion 7 protrudes from front 10 of base body 8 due to this curvature. By attaching base body 8 to the studded sheet, head portion 7, in particular wings 9 protruding from an outside 12, are in extensive surface contact at the top edge of the studded sheet. The biasing pressure resulting from the resilient deformation of head portion 7 results in the top edge of the studded sheet being pressed against the building wall and prevents the intrusion of dirt behind the studded sheet—as seen in the direction toward the building wall. As illustrated in *Figs*. 1, 2, and 3, wings 9 extend substantially laterally from the head portion 7.

On back 11 of attachment element 1, a connector 5 is arranged coaxial to opening 4, which is adapted to an automatic nailer, such as an apparatus made by Hilti, so that it is ensured that the attachment means arranged by the apparatus, such as nails, are rapidly and reliably positioned within opening 4. Reinforcement webs 6 extending from stud 3 toward a top edge of head portion 7 on back 11 of attachment element 1 improve the elasticity properties of attachment element 1, or its stability, and ensure in a particularly advantageous way that head portion 7 is pressed against the top edge of the studded sheet by the attachment of base body 8.

What is claimed is:

1. An attachment element for studded plastic sheets comprising: a base body with at least one stud projecting from a front of the base body, wherein a head portion extends on a periphery of the base body, which at least partially projects from the front of the base body with a resiliently deformable area, wherein the head portion has wings protruding from an outside of the head portion in an area facing away from the base body, and wherein said wings are not in direct contact with each other and extend substantially laterally from the head portion.

2. The attachment element according to claim 1, wherein one or more of the base body and the head portion is curved about at least one axis.

3. The attachment element according to claim 1, wherein the wings have a curvature adapted to the head portion.

4. The attachment element according to claim 1, wherein the wings have a boss protruding in cross-section from the front of the wings, the boss having a curved configuration.

5. The attachment element according to claim 4, wherein the cross-section of the boss varies in the longitudinal axis direction of the wings.

6. The attachment element according to claim 1, wherein the outside of the head portion has an arcuate configuration in a transition area to the wings.

7. The attachment element according to claim 1, wherein reinforcement webs are arranged on a back of the head portion and/or the base body.

8. The attachment element according to claim 7, wherein the reinforcement webs extend from an area for receiving an attachment means toward the outsides of the head portion.

9. The attachment element according to Claim 8, wherein a connector for an apparatus for arranging the attachment means is arranged in the area for receiving the attachment means.

10. The attachment element according to claim 9, wherein the connector is annular and is arranged coaxial to the opening on a back of the base body.

11. The attachment element according to claim 1, wherein the at least one stud of the base body is formed to receive an attachment means.

12. The attachment element according to claim 11, wherein the at least one stud has an opening to receive the attachment means, wherein the opening is arranged in a base of the stud.

13. The attachment element according to claim 11, wherein the at least one stud is configured essentially as a solid body to receive the attachment means.

14. The attachment element according to claim 1, wherein the base body has four or five studs.

15. The attachment element according to claim 1, wherein the at least one stud is cylindrically, conically, frusto-conically, pyramid-shaped, frusto-pyramid-shaped or dome-shaped.

16. The attachment element according to claim 1, wherein the base body and the head portion are integrally formed.

17. The attachment element according to claim 1, wherein the base body and the head portion are made of a thermoplastic plastic material.

18. The attachment element according to claim 1, wherein the base body and the head portion are made by injection molding of an impact-resistant copolymer having high bending strength and a high modulus of elasticity.

* * * * *